United States Patent [19]

Moonan et al.

[11] 3,944,115

[45] Mar. 16, 1976

[54] CONTAINER AND LID STRUCTURE

[75] Inventors: William Moonan, Shaker Heights, Ohio; John D. Czarnecki, Downers Grove, Ill.

[73] Assignee: The Sherwin-Williams Company, Cleveland, Ohio

[22] Filed: Nov. 7, 1974

[21] Appl. No.: 521,749

[52] U.S. Cl. ..... 220/355; 220/354

[51] Int. Cl.[2] ..... B65D 43/10

[58] Field of Search ..... 220/355, 354, 352

[56] References Cited

UNITED STATES PATENTS

| | | | |
|---|---|---|---|
| 1,206,475 | 11/1916 | Shalita | 220/355 |
| 2,734,654 | 2/1956 | Roberson | 220/355 |
| 3,770,161 | 11/1973 | Knize | 220/355 |

FOREIGN PATENTS OR APPLICATIONS

| | | | |
|---|---|---|---|
| 24,353 | 10/1907 | United Kingdom | 220/354 |

*Primary Examiner*—William Price
*Assistant Examiner*—Joseph M. Moy
*Attorney, Agent, or Firm*—Johnston, Keil, Thompson & Shurtleff

[57] ABSTRACT

A container and a lid therefor is provided in which the rim of the container has an inverted U-shaped raised portion which is engaged by a complementary shaped portion on the lid to secure the lid to the rim of the container, and in which the raised portion of the rim terminates in a bead extending inwardly with respect to said raised portion, the outer wall of the raised portion is longer than the inner wall, the outer wall of the complementary portion of the lid is longer than the inner wall of said complementary portion of the lid and the outer wall of the inverted U-shaped raised portion of the rim has a downwardly and outwardly extending portion extending toward the inner surface of the container and then upwardly along a vertical wall of the container, thereby providing a structure which is highly resistant to damage due to dropping or compression.

3 Claims, 2 Drawing Figures

CONTAINER AND LID STRUCTURE

BACKGROUND

One of the difficult problems in the container art and especially in the manufacture of containers for paint and similar products such as the metal containers in the one gallon sizes normally used in the paint industry as well as in other sizes has been the provision of containers and lids therefor which will withstand damage caused by dropping the container or by compression when containers are stacked on one another. When a container filled with a liquid such as paint which is normally quite heavy is dropped from a substantial distance, say from a height of 18 to 30 inches, there is a tendency for the container to come apart or be damaged in the area where the lid is secured to the container.

Once the seal between the lid and the container has been broken and the contents are exposed to air, the contents in many cases will be unusable unless the damage is detected within a short period of time and corrected or the contents removed from the container. In many cases once the lid and rim structure of the container has been damaged it is not possible to reapply the lid to the container and at the same time maintain a tight seal of the contents.

Many attempts have been made to solve this problem as illustrated by various structures suggested and taught in U.S. Pat. Nos. 2,273,247, 2,734,654, 2,905,357, 3,383,006 (Re.26,730), 3,410,448, 3,770,161 and 3,825,149. In general, these structures have provided some improvement in the art but they still leave much to be desired, especially when subjected to drop tests and compression tests.

OBJECTS

An object of the present invention is to provide a new and improved container and a lid for closing said container which is relatively simple to manufacture and has advantages over previously proposed structures with respect to resistance to damage as evaluated by drop tests and compression tests.

Other objects and advantages of the invention will appear from the following description in conjunction with the accompanying drawing.

THE DRAWING

FIG. 1 is a partial sectional view with parts broken away of a container illustrating a new and improved rim and lid structure provided in accordance with the invention; and FIG. 2 is similar to FIG. 1 except that it shows the position of the lid with respect to the rim of the container after the lid has been pressed firmly in place over the rim of the container so that the container is closed and the contents are sealed.

BRIEF SUMMARY OF THE INVENTION

In accordance with the invention, a container and a lid therefor is provided in which the rim of the container has an inverted U-shaped raised portion which is engaged by a complementary shaped portion on the lid to secure the lid to the rim of the container, and in which the raised portion of the rim terminates in a bead extending inwardly with respect to said raised portion, the outer wall of the raised portion is longer than the inner wall, the outer wall of the complementary portion of the lid is longer than the inner wall of said complementary portion of the lid and the outer wall of the inverted U-shaped raised portion of the rim has a downwardly and outwardly extending portion extending toward the inner surface of the container and then upwardly along a vertical wall of the container, thereby providing a structure which is highly resistant to damage due to dropping or compression.

DETAILED DESCRIPTION OF THE INVENTION

Figure 1:
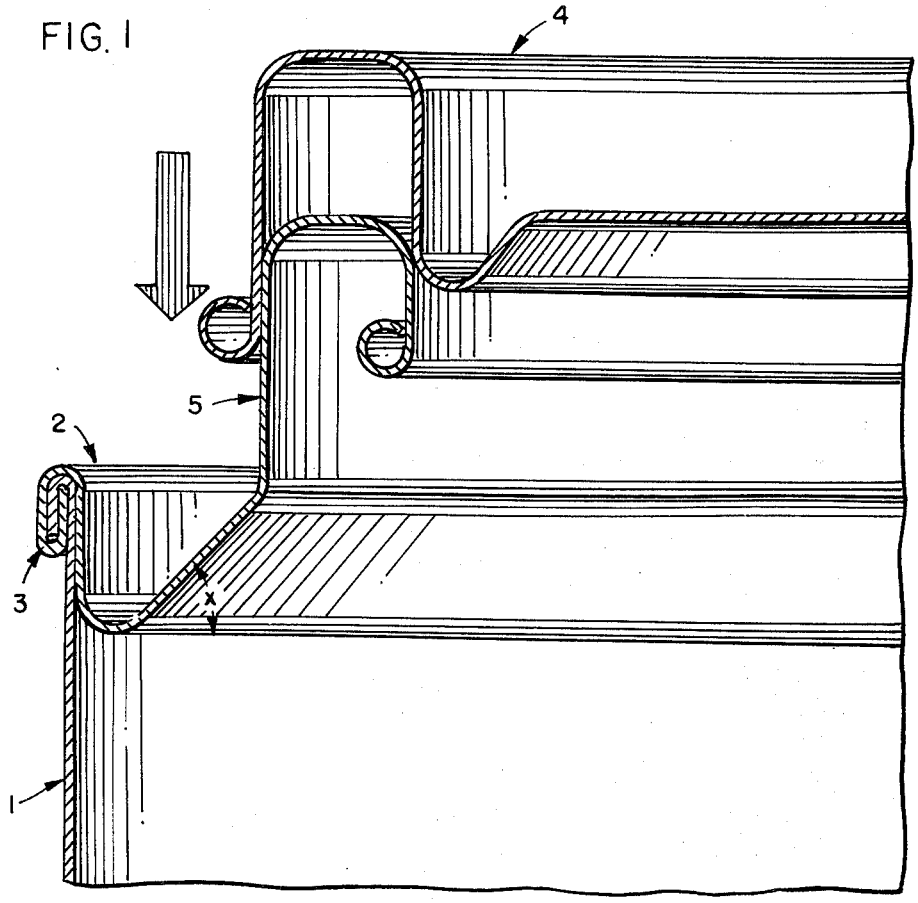

Referring to the drawing, FIG. 1, which is a partial section of a container and lid structure embodying the invention with parts broken away, illustrates a cylindrical container body 1 having a rim 2 which is attached to the top of the container body 1 in a conventional manner by an interlocking joint 3 which forms an airtight seal between the rim 2 and container body 1.

Figure 2:
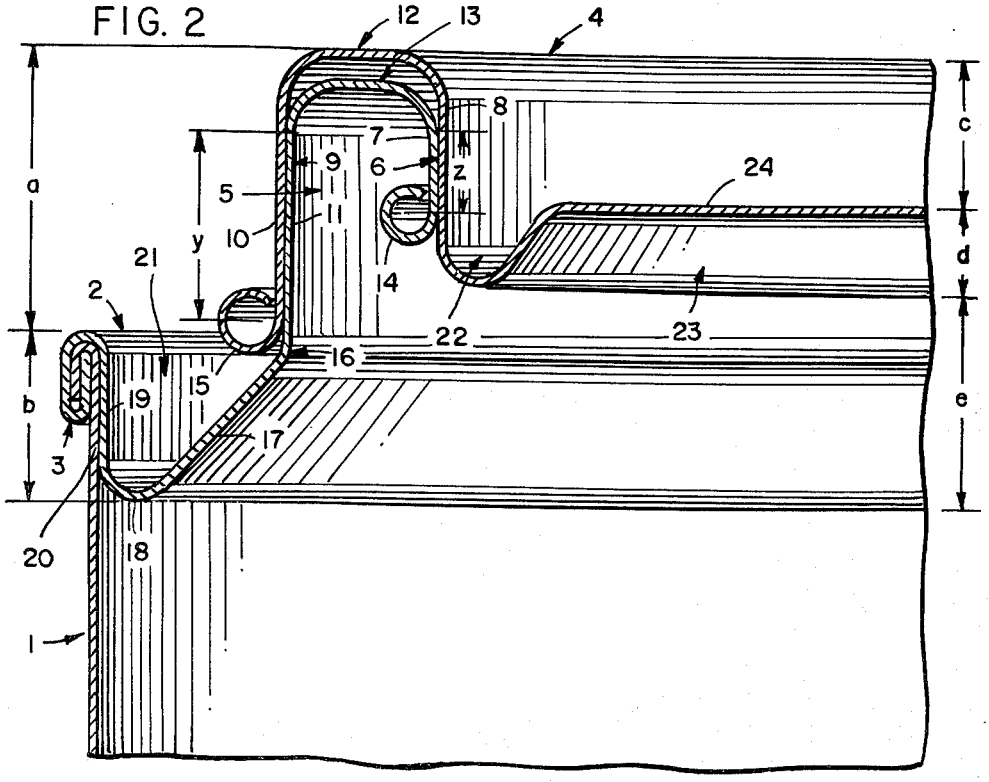

A lid 4 is shown in superposed position with respect to the raised portion 5 of rim 2. In this position the lid 4 is about to be applied to the raised portion 5 of rim 2, as shown in FIG. 1. In FIG. 2 the lid 4 has been pressed downwardly over the raised portion 5 of rim 2, thereby causing frictional engagement in the area 6 between the inner wall 7 of the raised portion 5 and the inner wall 8 of the complementary portion of the lid 4 and also in the area 9 between the inner surface of the outer wall 10 of the complementary portion of lid 4 and the outer surface of the outer wall 11 of the raised portion 5 of rim 2.

The area of frictional engagement 9 as shown at *y* is longer than the area of frictional engagement 6 as shown at *z*. This double frictional engagement serves as a seal after the lid has been applied to the rim of the container as shown in FIG. 2. The lid 4 may be applied to the container in any suitable manner by compressive force. One method of accomplishing this is to pass the container which has already been filled with the rim 4 loosely applied as in FIG. 1 on a suitable conveyor, for example, a roller conveyor, and gradually apply force by means of rollers or otherwise to the top of lid 4 so as to compress the lid and rim together. This may produce a flattening of the lid 4 in the area 12 and in some instances might cause the area 12 of lid 4 to contact and even flatten the area 13 of the raised portion 5 of rim 2. Regardless of whether there is a space between the areas 12 and 13, the contents of the can will be sealed by the double frictional engagement in the areas 6 and 9. The inner end of the raised portion 5 of rim 2 is rolled to form a bead 14 which extends outwardly from the vertical wall 7 of raised portion 5 into the space between the two sides 7 and 11 of raised portion 5. The bead 14 provides a rolled surface so that after the container is opened and the lid 4 removed therefrom, anyone contacting this surface will not encounter a sharp edge. Another function of the closed bead 14 is to prevent accumulation of rust or any other substances which might contaminate the contents of the container. The rolled bead 14 also makes it easier to remove and prevent the accumulation of contents of the container on the inside of raised portion 5 of rim 2. In addition, the rolled bead 14 acts as a reinforcement of the raised portion 5 in one of the areas of frictional contact between the rim 2 and the lid 4.

A rolled bead 15 is provided at the end of lid 4 and serves functions similar to those described with respect to rolled bead 14. The bead 15 has the additional function of providing an outwardly extending area against which leverage can be exerted in order to remove the lid 4 from the container. The beads 14 and 15 may be of substantially the same size or one can be larger than the other. Thus, satisfactory results are obtained with a structure in which the bead 14 is larger than the bead 15.

Usually when the container is sealed by applying the lid 4 the dimensions of the side 11 of raised portion 5 and the side 10 of lid 4 are such that the bead 15, after application of the lid 4, remains slightly above the juncture 16 with the downwardly and outwardly extending portion 17 of rim 2. However, the bead 15 can be forced downwardly so that it fills the outer surface of juncture 16 and is complemental thereto.

The downwardly and outwardly extending portion 17 of rim 2 preferably makes an angle of 45° with the surface 18 as indicated by the angle *x* in FIG. 1. The tapering surface 17 assists in withstanding the axial load during the closing process and also adds to the ability of the rim and lid structure to withstand compressive axial pressure when filled containers are stacked on one another or when they are dropped. The rim extends upwardly at 19 to form a vertical wall which is in contact with the vertical wall 20 of container 1. The side walls 17, 18 and 19 of the rim structure form an annular recess 21 in the rim 2 around the top of the container.

The lid 4 contains an annular recess 22 and a reentrant portion 23, the top 24 of which is flat or horizontal. This reentrant portion and the annular recess 23 increase the strength of the lid 4 and tend to enhance the frictional engagement between the side 8 of the lid and the side 7 of the raised portion 5 of rim 2 in the area 6.

While the dimensions of the container and the various portions of the rim and lid structures may vary, a typical one gallon paint container would have a wall diameter of 6.5 inches. The angle *x* would be 45°. The distance y would be 0.156 inch. The distance *z* would be 0.131 inch. The distance *a* would be 0.325 inch. The distance *b* would be 0.19 inch. The diameter of the flat panel 24 would be 5.24 inches. The distance *c* would be 0.185 inch. The distance *d* would be 0.135 inch. The distance *e* would be 0.205 inch. These dimensions are subject to variation. Thus, the distance *z* might be 0.092 inch and the distance *y* 0.23 inch. The distance *a* might be 0.375 inch. The distance *c* might be 0.203 inch. The distance *d* might be 0.106 inch. The distance *e* might be 0.241 inch. On a cylindrical container where the diameter of the container is 6.5 inches, the diameter of the outer wall of the raised portion 5 might be 6.0 inches. The diameter of the inner wall 7 of the raised portion 5 might be 5.59 inches.

Tests made with containers constructed as previously described by dropping one gallon metal containers filled with paint from heights of 18 inches, 24 inches and 30 inches in vertical drops have shown that these containers have excellent ability to withstand such tests. They also have the ability to withstand dropping from heights of 18 inches with the container at an angle of 20° from horizontal so that the bottom edge of the container strikes the surface against which it is dropped. In addition these containers are highly resistant to failure due to compressive forces applied against the top and bottom of the containers.

The invention is hereby claimed as follows:

1. A container and a lid for closing said container, said container having a rim, said rim having a raised portion spaced inwardly of the side wall of the container, said raised portion being of an inverted U-shape which comprises an outer vertical wall and a spaced inner vertical wall connected by a transversely extending top portion, said outer vertical wall being longer than said inner vertical wall of said raised portion of said rim, the lower end of said outer vertical wall of said raised portion extending downwardly and outwardly toward the inner surface of said container in a straight line at an angle of approximately 45° to the vertical and then upwardly along a vertical wall of said container, the lower end of the inner vertical wall of said raised portion of said rim terminating in a bead extending inwardly with respect to said raised portion, said lid having a complemental portion adapted to overlie and continuously frictionally engage the vertical walls of said raised portion of said rim, the friction engaging surfaces between the outer wall of said complemental portion of said lid and the outer wall of said raised portion of said rim being longer than the friction engaging surfaces between the inner wall of said complemental portion of said lid and the inner wall of said raised portion of said rim, the outer wall of said complemental portion of said lid terminating in a bead extending outwardly, said bead on the outer wall of the complemental portion of said lid extending to a point just short of the juncture of said outer vertical wall of said raised portion of said rim and said downwardly and outwardly extending portion of said rim, and the inner wall of said complemental portion of said lid extending downwardly beyond said bead at the inner end of said raised portion of said rim.

2. A container as claimed in claim 1 in which the transverse sections of the inverted U-shaped rim and lid are flattened when the lid is applied to the rim of the container.

3. A container as claimed in claim 1 in which said lid has a central reentrant portion which is flat.

* * * * *